US006355348B1

(12) United States Patent
Takesue et al.

(10) Patent No.: US 6,355,348 B1
(45) Date of Patent: Mar. 12, 2002

(54) COMPOSITE-FIBER NONWOVEN FABRIC

(75) Inventors: Kunihiko Takesue; Masahiro Kishine, both of Yokkaichi (JP)

(73) Assignee: Mitsui Chemicals, Inc., Tokyo (JP)

( * ) Notice: Subject to any disclaimer, the term of this patent is extended or adjusted under 35 U.S.C. 154(b) by 0 days.

(21) Appl. No.: 09/622,009

(22) PCT Filed: Dec. 15, 1999

(86) PCT No.: PCT/JP99/07026

§ 371 Date: Aug. 11, 2000

§ 102(e) Date: Aug. 11, 2000

(87) PCT Pub. No.: WO00/36200

PCT Pub. Date: Jun. 22, 2000

(30) Foreign Application Priority Data

Dec. 16, 1998 (JP) ..... 10-357416

(51) Int. Cl.[7] ..... D01F 8/00

(52) U.S. Cl. ..... 428/373; 428/374; 428/370

(58) Field of Search ..... 442/401; 428/373, 428/374, 370, 369

(56) References Cited

U.S. PATENT DOCUMENTS

| | | | | |
|---|---|---|---|---|
| 4,477,516 A | | 10/1984 | Sugihara et al. | 428/296 |
| 5,456,982 A | * | 10/1995 | Hansen et al. | 428/373 |
| 5,622,772 A | * | 4/1997 | Stokes et al. | 428/374 |
| 5,635,290 A | * | 6/1997 | Stopper et al. | 428/373 |

FOREIGN PATENT DOCUMENTS

| | | |
|---|---|---|
| GB | 2121423 A | 12/1983 |
| JP | 63105111 A | 5/1988 |
| JP | 6420322 | 1/1989 |
| JP | 03064519 A | 3/1991 |
| JP | A5186955 | 7/1993 |
| JP | A754215 | 2/1995 |
| JP | A-10158969 | 6/1998 |

* cited by examiner

*Primary Examiner*—N. Edwards
(74) *Attorney, Agent, or Firm*—Birch, Stewart, Kolasch & Birch, LLP

(57) ABSTRACT

The conjugate fiber nonwoven fabric of the present invention comprises conjugate fibers, preferably core-sheath-type or side-by-side-type conjugate fibers, composed of a polyethylene-based resin (A) having a higher melting point in the range of 120 to 135° C. and a lower melting point in the range of 90 to 125° C., which is lower than the above higher melting point at least by 5° C., and a high-melting point resin (B) whose melting point is higher than that of the above polyethylene-based resin (A) by 10° C. or more, the component ratio by weight of the polyethylene-based resin (A) to the high-melting point resin (B) (A/B) being in the range of 50/50 to 10/90, and the polyethylene-based resin (A) forming at least part of the surface of the fiber longitudinally continuously. This conjugate fiber nonwoven fabric has an excellent softness and a high strength, and it is suitably used as a nonwoven fabric for sanitary materials.

14 Claims, 2 Drawing Sheets

COMPOSITE-FIBER NONWOVEN FABRIC

This application is the national phase under 35 U.S.C. §371 of PCT International Application No. PCT/JP99/07026 which has an International filing date of Dec. 15, 1999, which designated the United States of America.

TECHNICAL FIELD

The present invention relates to a conjugate fiber nonwoven fabric not only excellent in softness, but also high in strength, and to a nonwoven fabric for use in sanitary materials which utilize the above conjugate fiber nonwoven fabric.

TECHNICAL BACKGROUND

Spunbonded nonwoven fabrics, which have been used in a wide variety of applications in recent years, offer the advantages of being excellent in tensile strength and high in productivity over short fiber nonwoven fabrics produced by the carding or the melt-blowing process. On the other hand, compared with the short fiber nonwoven fabrics, they are poor in softness, therefore, they are less adequate for applications where they directly touch a person's skin, for example, for the application to surface material for sanitary goods. However, for applications to disposables, spunbonded fabrics are suitable due to their high productivity; thus there have been adopted various techniques for producing spunbonded fabrics more excellent in softness.

For example, there has been made a proposal to provide properly spaced binding zones for binding fibers, which are to be formed into a nonwoven fabric, so that the fibers can fusion bond together exclusively within the binding zones, whereby regions where fibers do not bind with each other can be created.

The nonwoven fabrics, however, have not exhibited an adequate softness with this technique alone.

A polyethylene nonwoven fabric, which resin fibers are formed of polyethylene, is known for its softness and good touch (Japanese Patent Laid-Open No. 60-209010). Polyethylene fibers are, however, difficult to spin, and hence difficult to allow to have a fine denier. And a nonwoven fabric formed of polyethylene fibers easily melts when subjected to heat/pressure treatment with a calender roll, and what is even worse, it easily winds itself around the roll due to low strength of the fibers. Measures have been taken against the above problems in which the treatment temperature is decreased; however, in such a case, thermal adhesion is apt to be insufficient, which leads to another problem of being unable to obtain nonwoven fabric with sufficient strength and fastness to rubbing. In actuality, a polyethylene nonwoven fabric is inferior to a polypropylene nonwoven fabric in strength.

In order to solve the above problems, there have been proposed techniques of utilizing a core-sheath-type conjugate fiber using a resin of polypropylene, polyester, etc., as a core, and polyethylene as a sheath (Japanese Patent Publication No. 55-483, Japanese Patent Laid-Open No. 2-182960 and Japanese Patent Laid-Open No. 5-263353).

However, the currently proposed nonwoven fabrics, which are formed of core-sheath-type conjugate fibers as described above, have not had both softness and strength adequate to be used as sanitary materials. Specifically, when increasing the amount of polyethylene as a constituent of sheath, the softness of the nonwoven fabric is enhanced, but its strength is not allowed to be sufficient, as a result of which it is likely to fracture during the process. On the other hand, when increasing the constituent of core, the nonwoven fabric is allowed to have sufficient strength, but is poor in softness and its quality, as a material for sanitary goods, decreases. Thus it has been difficult to obtain a nonwoven fabric having both of the above performances on a satisfactory level.

Accordingly, the object of the present invention is to solve the aforementioned problems the background arts have, in particular, to provide a conjugate fiber nonwoven fabric with excellent softness and touch as well as with sufficient strength.

DISCLOSURE OF THE INVENTION

In order to achieve the above object, the present inventors provide a conjugate fiber nonwoven fabric which comprises conjugate fibers, preferably core-sheath-type or side-by-side-type conjugate fibers, composed of a polyethylene-based resin (A) having a higher melting point in the range of 120 to 135° C. and a lower melting point in the range of 90 to 125° C., which is lower than the above higher melting point at least by 5° C., and a high-melting point resin (B) whose melting point is higher than that of the above polyethylene-based resin (A) by 10° C. or more, the component ratio by weight of the polyethylene-based resin (A) to the high-melting point resin (B) being in the range of 50/50 to 10/90, and the polyethylene-based resin (A) forming at least part of the surface of the fiber longitudinally continuously.

In a preferred embodiment of the present invention, desirably the above polyethylene-based resin (A) comprises an ethylene-based polymer having a higher melting point in the range of 120 to 135° C. and a lower melting point in the range of 90 to 125° C. which is lower than the above higher melting point at least by 50° C.

Desirably the above polyethylene-based resin (A) comprises an ethylene-based polymer (A-1) having a higher melting point in the range of 120 to 135° C. and an ethylene-based polymer (A-2) having a lower melting point in the range of 90 to 125° C. which is lower than the above higher melting point at least by 5° C.

In this case, preferably the weight ratio [(A-1)/(A-2)] of the ethylene-based polymer (A-1) to the ethylene-based polymer (A-2), both contained in the polyethylene-based resin (A), is in the range of 75/25 to 30/70.

Preferably the density of the ethylene-based polymer (A-1) is in the range of 0.930 to 0.970 g/cm$^3$ and that of the ethylene-based polymer (A-2) is in the range of 0.860 to 0.930 g/cm$^3$.

In the present invention, suitably the above polyethylene-based resin (A) has a molecular weight distribution (Mw/Mn) in the range of 1.5 to 4.0 when measuring by the gel permeation chromatography (GPC).

Suitably the high-melting point resin (B) is propylene-based polymer having a molecular weight distribution (Mw/Mn) in the range of 2.0 to 4.0 when measuring by the GPC.

Preferably the propylene-based polymer is a propylene-ethylene copolymer with a melt flow rate in the range of 20 to 100 g/10 min (measured at a load of 2.16 kg and at 230° C. in accordance with ASTM D1238) and an ethylene-derived structural unit content in the range of 0.1 to 5.0 mol %.

The present invention also provides a nonwoven fabric used as sanitary materials which is formed as a laminate of the above conjugate fiber nonwoven fabric and a melt-blown nonwoven fabric.

BEST EMBODIMENTS OF THE INVENTION

Now the conjugate fibers according to the present invention and the conjugate fiber nonwoven fabrics formed from the above fibers will be described in detail below. The term "polymer" used herein shall include both a homopolymer and a copolymer.

Conjugate Fiber

The conjugate fibers according to the present invention are such that they are composed of a polyethylene-based resin (A) with a higher melting point in the range of 120 to 135° C., preferably in the range of 120 to 130° C., and a lower melting point in the range of 90 to 125° C., preferably in the range of 90 to 120° C., which is lower than the above higher melting point at least by 5° C., preferably at least by 10° C., and a high-melting point resin (B) with a melting point higher than that of the above polyethylene-based resin (A) by 10° C. or more, preferably 15° C. or more, and more preferably 20° C. or more, the above polyethylene-based resin (A) forming at least part of the surface of the fiber longitudinally continuously.

Suitable concrete examples of the above conjugate fibers include, for example, a core-sheath-type conjugate fiber composed of a sheath portion comprised of the polyethylene-based resin (A) and a core portion comprised of the high-melting point resin (B) with a melting point higher than that of the above polyethylene-based resin (A) by 10° C. or more, preferably 15° C. or more, more preferably 20° C. or more, and a side-by-side-type conjugate fiber composed of a polyethylene-based resin portion comprised of the above polyethylene-based resin (A) and a high-melting point resin portion comprised of the above high-melting resin (B). Each of the conjugate fibers will be described below.

Core-Sheath-Type Conjugate Fiber

The polyethylene-based resin (A) forming the sheath portion of a core-sheath-type conjugate fiber is an ethylene-based polymer with a higher melting point in the range of 120 to 135° C., preferably in the range of 120 to 130° C., and a lower melting point in the range of 90 to 125° C., preferably in the range of 90 to 120° C., which is lower than the above higher melting point at least by 5° C., preferably at least by 10° C., or a mixture of two or more ethylene-based polymers. In other words, the polyethylene-based resin (A) preferably used in the present invention is an ethylene-based polymer having two or more different melting points as described above or a mixture of two or more ethylene-based polymers each of which has a melting point different from each other as described above.

Figure 1:
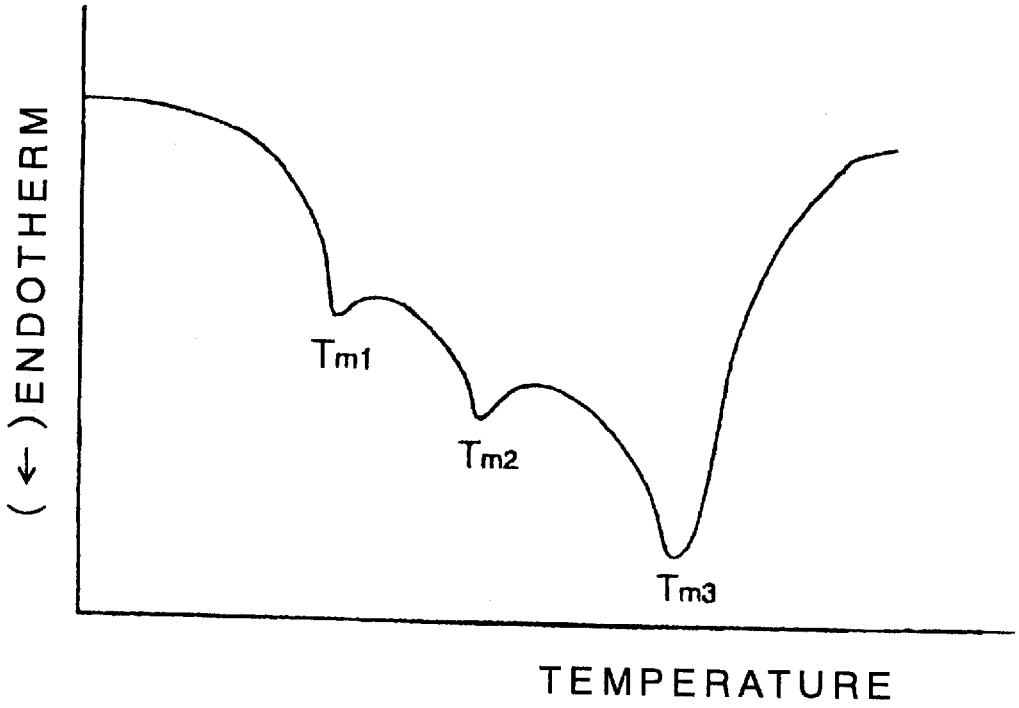
FIGS. 1 to 3 are views showing examples of DSC curves (curves of differential thermal analysis) of the polyethylene-based resin (A).
Figure 2:
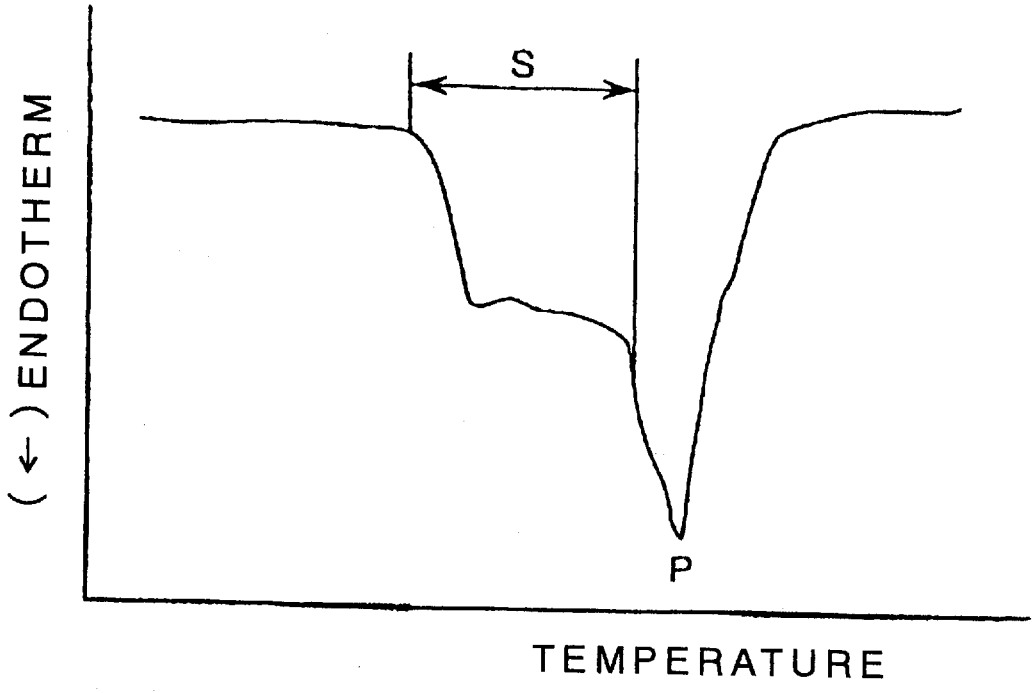
Figure 3:
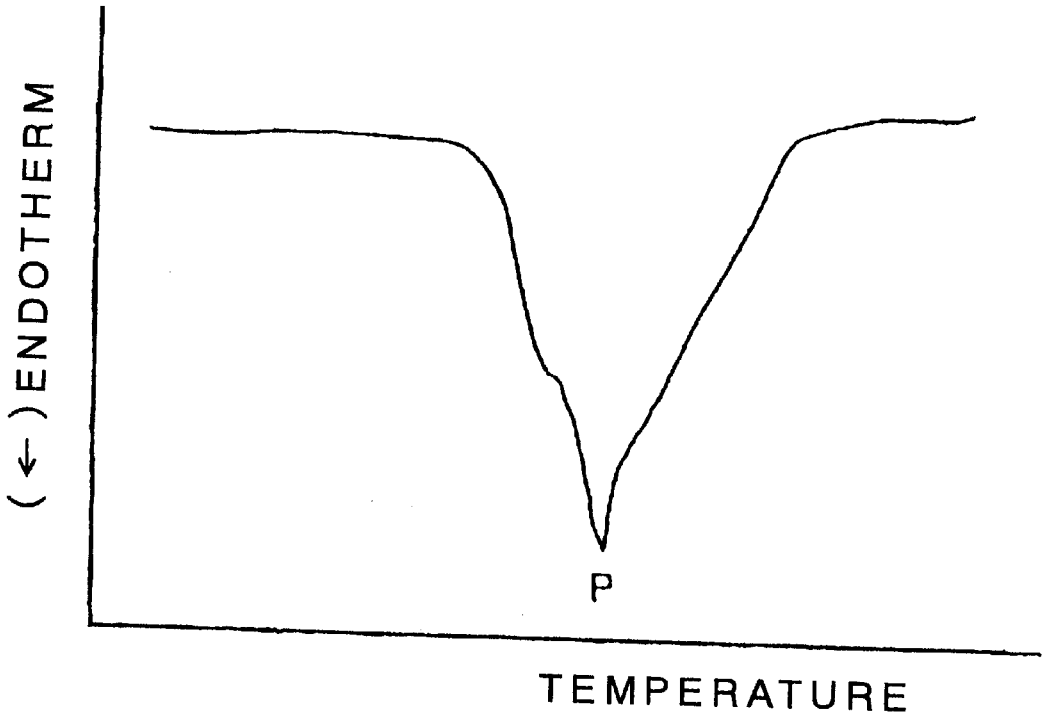

Such polyethylene-based resin (A) includes, for example, polyethylene-based resin whose DSC curve (curve of differential thermal analysis) has two or more endothermic peaks (Tm1, Tm2, Tm3), as shown in FIG. 1, and polyethylene-based resin whose DSC curve has a peak (P) and a portion (S) in which endotherm (endothermic quantity) increases gently and the existence of a peak can be observed, as shown in FIG. 2. In addition, the polyethylene-based resin (A) whose DSC curve has a single peak, as shown in FIG. 3, may include a mixture of two or more polyethylene-based resins at least one of which has a low melting point in the range described above, and at least one of which has a high melting point in the range described above which is higher than the above lower melting point at least by 5° C., preferably at least by 10° C. The mixture can be prepared by any one of the methods, such as dry blending, melt blending and multistage polymerization having 2 or more stages. The term "peak" used herein means the point on a DSC curve at which the differential quotient of the endotherm variation curve changes from positive to negative or negative to positive, and it does not include the points on what is called the shoulder of a curve.

The ethylene-based polymers used in the present invention include, for example, ethylene homopolymer and copolymers of ethylene and α-olefin, such as propylene, 1-butene, 1-hexene, 4-methyl-1-pentene and 1-octene.

Preferably α-olefin content of these ethylene-α-olefin copolymers is 30 mol % or less.

When the above polyethylene-based resin (A) is a mixture of two or more ethylene-based polymers, preferably the weight ratio of the ethylene-based polymer (A-1) contained in the mixture with the high-melting point range described above to the ethylene-based polymer (A-2) contained in the same with the low-melting point range described above [(A-1)/(A-2)] is in the range of 75/25 to 30/70, more preferably in the range of 70/30 to 50/50, in terms of obtaining a fiber excellent in softness and fastness to rubbing.

When the above polyethylene-based resin (A) is a mixture of two or more ethylene-based polymers, the suitable density range for the ethylene-based polymer (A-1) is 0.930 to 0.970 g/cm$^3$, more preferably 0.940 to 0.970 g/cm$^3$ and the suitable density range for the ethylene-based polymer (A-2) is 0.860 to 0.930 g/cm$^3$, more preferably 0.860 to 0.920 g/cm$^3$.

The polyethylene-based resin (A) which is the aforementioned ethylene-based polymer or mixture of ethylene-based polymers of two types or more being different in melting point from each other, preferably has a melt flow rate (MFR; measured at 190° C. and a load of 2.16 kg in accordance with ASTM D1238) in the range of 20 to 60 g/10 min, in terms of obtaining a fiber excellent in spinnability, fiber strength and fastness to rubbing.

Preferably the molecular weight distribution (Mw/Mn) of the polyethylene-based resin (A), when measuring by the gel permeation chromatography (GPC), is in the range of 1.5 to 4.0, and particularly preferably in the range of 1.5 to 3.0 in terms of obtaining a fiber excellent in spinnability, fiber strength and fastness to rubbing.

Preferably the density (ASTM D1505) of the polyethylene-based resin (A) is in the range of 0.920 to 0.970 g/cm$^3$ in terms of obtaining a fiber excellent in fastness to rubbing, preferably in the range of 0.940 to 0.960 g/cm$^3$ in terms of obtaining a fiber having softness and sufficient fastness to rubbing, more preferably in the range of 0.940 to 0.955 g/cm$^3$, and particularly preferably in the range of 0.940 to 0.950 g/cm$^3$.

In the mean time, a high-melting point resin (B) forming the core portion of the core-shear-type conjugate fiber according to the present invention is a thermoplastic resin having a melting point higher than that of the above polyethylene-based resin (A) by 10° C. or more. And in cases where the polyethylene-based resin (A) has more than one melting points, the high-melting point resin (B) has a melting point higher than the highest one of the polyethylene-based resin (A) by 10° C. or more, preferably 15° C. or more, and more preferably 20° C. or more. These high-melting point resins (B) include, for example, polyolefin resins such as propylene-based polymers, polyester resins such as polyethylene terephthalate (PET) and polyamide resins such as nylon. Among all the above resins, propylene-based polymers are preferable.

The propylene-based polymers include, for example, propylene homopolymer or copolymers of propylene and α-olefin, such as ethylene, 1-butene, 1-hexene, 4-methyl-1-pentene and 1-octene. Among all the above copolymers, particularly preferable are propylene-ethylene random copolymer comprised of propylene and a small amount of ethylene whose ethylene-derived structural unit content is 0.1 to 5 mol %. The use of copolymer of this type provides good spinnability and productivity of their conjugate fibers and a nonwoven fabric having good softness. The term "good spinnability" used herein means that neither yarn breaking nor filament fusing occurs during extrusion from spinning nozzles and during drawing.

Preferably the propylene-based polymers have a melt flow rate (MFR; measured at 230° C. and at a load of 2.16 kg in accordance with ASTM D1238) in the range of 20 to 100 g/10 min in terms of obtaining a fiber particularly excellent in balance of spinnability and fiber strength.

Preferably the molecular weight distribution (Mw/Mn) of the propylene-based polymers, when measuring by the gel permeation chromatography (GPC), is in the range of 2.0 to 4.0, and more preferably the Mw/Mn is in the range of 2.0 to 3.0 in terms of obtaining a conjugate fiber good in spinnability and particularly excellent in fiber strength.

In the present invention, without departing its spirit and scope, the polyethylene-based resin (A) forming the sheath portion of the fiber and/or the high-melting point resin (B), such as propylene-based polymers, forming the core portion of the same may be blended with a coloring material, a thermoresistance stabilizer, a lubricant, a nucleating agent and other polymers according to the situation.

The coloring materials applicable to the present invention include, for example, inorganic coloring materials, such as titanium oxide and calcium carbonate, and organic coloring materials, such as phthalocyanine.

The thermoresistance stabilizers include, for example, phenol-based stabilizers such as BHT (2,6-di-t-butyl-4-methylphenol).

The lubricants include, for example, oleic amide, erucic amide and stearic amide. In the present invention, particularly preferably 0.1 to 0.5 wt. % of lubricant is blended with the polyethylene-based resin (A) forming the sheath portion, since the conjugate fiber obtained in the above manner has an enhanced fastness to rubbing.

Preferably the component ratio by weight of the polyethylene-based resin (A) to the high-melting point resin (B) (the polyethylene-based resin (A)/the high-melting point resin (B)) is in the range of 50/50 to 10/90, and in terms of obtaining a fiber excellent in balance of softness and fastness to rubbing, preferably in the range of 50/50 to 20/80 and more preferably in the range of 40/60 to 30/70. When the proportion of the polyethylene-based resin (A) to a conjugate fiber (parts by weight of the polyethylene-based resin (A) in 100 parts of the whole conjugate fiber) exceeds 50, there may exist some parts not having been improved in fiber strength. On the other hand, when the proportion of the polyethylene-based resin (A) to a conjugate fiber is as low as less than 10, there may exist some parts poor in both softness and touch in the obtained fabric.

The area ratio of the sheath portion to the core portion in a cross section of the core-sheath-type conjugate fiber according to the present invention is generally almost the same as the component ratio by weight described above, and is in the range of 50/50 to 10/90, preferably in the range of 50/50 to 20/80, and more preferably in the range of 40/60 to 30/70.

For the above core-sheath-type conjugate fiber, preferably its fineness is 5.0 deniers or lower, and in terms of obtaining a fiber more excellent in softness, more preferably 3.0 deniers or lower.

The core-sheath-type conjugate fiber according to the present invention may be a concentric type one where the circular core portion and the doughnut-shaped sheath portion have the same center in the same cross section of the fiber, the core portion being wrapped up in the sheath portion, or an eccentric type one where the centers of the core portion and the sheath portion are different from each other. In addition, the core-sheath-type conjugate fiber may be an eccentric type one where the core portion is partially exposed on the surface of the fiber.

Side-by-Side-Type Conjugate Fiber

The side-by-side-type conjugate fiber according to the present invention is composed of a polyethylene-based resin portion comprised of a polyethylene-based resin (A) and a high-melting point resin portion comprised of a high-melting point resin (B). The polyethylene-based resin (A) and the high-melting point resin (B) both forming the side-by-side-type conjugate fiber are the same as the polyethylene-based resin (A) and the high-melting point resin (B) both forming the core-sheath-type conjugate fiber describe above, respectively.

In the present invention, without departing its spirit and scope, the polyethylene-based resin (A) and/or the high-melting point resin (B) may be blended with the aforementioned coloring material, thermoresistance stabilizer, lubricant, nucleating agent and other polymers, according to the situation.

For the side-by-side-type conjugate fiber, preferably the component ratio by weight of the polyethylene-based resin (A) to the high-melting point resin (B) (A/B) is in the range of 50/50 to 10/90, and in terms of obtaining a fiber excellent in balance of softness and fastness to rubbing, preferably in the range of 50/50 to 20/80 and more preferably in the range of 40/60 to 30/70.

For the side-by-side-type conjugate fiber according to the present invention described above, preferably its fineness is 5.0 deniers or lower, and in terms of obtaining a fabric more excellent in softness, preferably 3.0 deniers or lower.

Conjugate Fiber Nonwoven Fabric

A conjugate fiber nonwoven fabric according to the present invention is obtained using the conjugate fibers composed of the above polyethylene-based resin (A) and high-melting point resin (B) in which the polyethylene-based resin (A) forms at least part of the surface of the fiber longitudinally continuously. Suitably the nonwoven fabric is comprised of the aforementioned core-sheath-type or side-by-side-type conjugate fibers, and the web of the conjugate fibers is usually subjected to entangling treatment by the hot embossing process using an embossing roll.

For the conjugate fiber nonwoven fabric according to the present invention, for example, a high-melting point resin (B) forming the core portion of the core-sheath-type conjugate fiber and a polyethylene-based resin (A) forming the sheath portion of the same are independently melted in extruder, etc., and each molten is extruded through a spinneret with bi-component fiber spinning nozzles constructed to extrude the molten in such a manner as to form a desired core-sheath structure, so that a core-sheath-type conjugate fiber is spun out. The spun conjugate fiber is then cooled with a cooling fluid, allowed to receive a tensile force by drawing air to have a predetermined fineness, and collected on a collecting belt to deposit thereon to a predetermined thickness, so that the web of the conjugate fiber can be obtained. Then, the conjugate fiber nonwoven fabric can be prepared by subjecting the web to entangling, for example, by the hot embossing process using an embossing roll.

Alternatively, the use of bi-component fiber spinning nozzles for side-by-side-type conjugate fiber instead of the above bi-component fiber spinning nozzles for core-sheath-type conjugate fiber provides a nonwoven fabric comprised of the side-by-side-type conjugate fibers according to the present invention.

An embossed area ratio (a stamped area ratio: the proportion of the portion subjected to thermocompression bonding to the whole nonwoven fabric) can be determined properly according to the applications. Generally, when the embossed area ratio is in the range of 5 to 40%, a conjugate fiber nonwoven fabric excellent in balance of softness, air permeability and fastness to rubbing can be obtained.

The conjugate fiber nonwoven fabric according to the present invention is a soft nonwoven fabric in which the sum of stiffness in both the longitudinal and transverse directions in accordance with the Clark method (JIS L1090 C method) is 80 mm or less (the value at the basis weight of 23 g/M$^2$), preferably 75 mm or less (the value at the basis weight of 23 g/M$^2$). The term "longitudinal direction" used herein means the direction parallel to the web flow during the formation of the nonwoven fabric (MD), and the term "transverse direction" used herein means the direction perpendicular to the web flow (CD).

Tensile strength of the conjugate fiber nonwoven fabric according to the present invention is generally 1800 g/25 mm or more, preferably 1900 g/25 mm or more in the longitudinal direction (MD), and generally 150 g/25 mm or more, preferably 200 g/25 mm or more in the transverse direction (CD), as the value at basis weight of 23 g/m$^2$.

The reasons why the conjugate fiber nonwoven fabric according to the present invention has excellent properties of softness and tensile strength will be described below.

In the entangling treatment of conventional conjugate fibers by the hot embossing process, the temperature range suitable for embossing treatment is narrow, and the temperature control is very severe. Thus, when embossing treatment is performed at higher temperatures compared with the suitable temperature, the problem arises that the fibers are likely to wind themselves around the heated roll, and when embossing treatment is performed at lower temperatures, the problem arises that the fusion defects are likely to occur among the fibers.

The fusion defects are more likely to occur particularly when increasing the content of the high-melting point resin so as to enhance the strength of the nonwoven fabric. In such a condition, measures need to be taken to increase the embossing treatment temperature, as a result of which embossed portions take the form of a film, leading to a decrease in softness. On the other hand, in the conjugate fiber nonwoven fabrics according to the present invention, the temperature range suitable for embossing treatment is wide, and the embossing treatment at suitable temperatures is easy. Thus fusion among the fibers at embossed portions is mild, and the fibers at embossed portions are allowed to keep themselves in the form of a fiber without taking the form of a film, which rarely leads to a decrease in softness.

The conjugate fiber nonwoven fabrics according to the present invention whose basis weight of 25 g/m$^2$ or less are generally suitable for the applications where softness is required; however, the nonwoven fabrics with the basis weight exceeding 25 g/m$^2$ may be used depending on the applications. For example, nonwoven fabrics with a high basis weight are suitable for a furoshiki (a wrapping cloth) and covering cloths for medical use.

Further, the present invention provides a nonwoven fabric used for the sanitary materials particularly suitable for the sanitary goods, such as disposable diaper and sanitary napkin, using the conjugate nonwoven fabric described above with a melt-blown nonwoven fabric formed from fibers having 1 to 10 $\mu$m of diameter laminated on its both sides or one side, so as to form a laminated nonwoven fabric of 2 or more layers which is good not only in softness and strength, but also in touch and water impermeability.

The fibers forming the melt-blown nonwoven fabric are not restricted to any specific types, and include, for example, single fibers formed from a known thermoplastic resin and conjugate fibers of core-sheath-type or side-by-side-type.

EXAMPLES

The present invention will be described in further detail with reference to the examples and comparative examples shown below. For the nonwoven fabrics of the examples and comparative examples shown below, evaluations of softness and spinnability and measurements of tensile strength, water impermeability, melting points of resins and Mw/Mn were carried out respectively in accordance with the following methods.

(1) Softness (Stiffness)

The stiffness of the nonwoven fabrics (the basis weight was 23 g/m$^2$ in the fabric of a single layer and 17 g/m$^2$ in the laminated fabric) in both the longitudinal and transverse directions were measured in accordance with the C method (Clark method) described in JIS L1096. The sum of the above measurements was used as the evaluation criterion for the softness of the nonwoven fabrics.

(2) Spinnability

Filament breaking was observed visually during the filament formation. 10-minute observation was performed for 1000 filaments, and the spinnability was evaluated using the judgment criteria shown below.

o: No yarn breaking observed x: One time or more of yarn breaking observed.

(3) Tensile Strength

Tensile strength was measured for specimen of 25 mm in width and 20 mm in length at the grip intervals of 100 mm and at the pulling rate of 100 mm/min in accordance with JIS L1906.

(4) Water Impermeability

Water impermeability was measured in accordance with the A method: the low hydraulic method, described in JIS L1092, (5) Melting Point Melting point was measured by the DSC at the temperature increasing rate of 10° C./min in accordance with JIS K7121.

(6) Mw/Mn (Molecular Weight Distribution)

Mw/Mn was obtained by measuring by the GPC (gel permeation chromatography) using ortho-dichlorobenzene solvent at 140° C. and converting measured value into polystyrene molecular weight.

Example 1

A polyethylene-based resin mixture (the physical properties of the mixture are shown in Table 1) consisting of 70 parts by weight of polyethylene (HDPE, comonomer: 1-butene) [resin 1] having a density (measured in accordance with ASTM D1050, hereinafter the same) of 0.965 g/cm$^3$ and a melting point of 130° C. and 30 parts by weight of LLDPE (comonomer: 4-methyl-1-pentene) [resin 2] having a density of 0.915 g/cm$^3$ and a melting point of 115° C., and polypropylene having ethylene content of 0.4 mol % and a melting point of 165° C. were independently subjected to melt kneading by extruder. Then each molten was extruded through a spinneret with bi-component fiber spinning nozzles constructed in such a manner as to extrude the molten to form a core-sheath structure, so that the molten matter was subjected to conjugate spinning to form a concentric core-sheath-type conjugate fibers composed of a core portion comprised of the polypropylene and a sheath portion comprised of the above polyethylene-based resin mixture. The web formed by depositing the core-sheath-type conjugate fibers obtained in the above manner on a collecting surface was subjected to entangling treatment by the hot embossing using an embossing machine consisting of a pair of steel embossing roll (roll diameter: 400 mm, stamped area ratio: 25%) having surface temperature of 121° C. and steel mirror roll (roll diameter: 400 mm), so as to obtain a conjugate fiber nonwoven fabric.

For the core-sheath-type conjugate fibers forming the nonwoven fabric obtained as described above, its fineness was 3.0 deniers and the component ratio by weight of polyethylene-based resin mixture (sheath portion) to polypropylene (core portion) was 30/70. Evaluation results for this nonwoven fabric are shown in Table 1.

Example 2

A conjugate fiber nonwoven fabric was obtained in the same manner as in the example 1, except that the blend proportions of polyethylene having a melting point of 130° C. [resin 1] and LLDPE having a melting point of 115° C. [resin 2] to the polyethylene-based resin mixture, which consisted of the above two types resins, were 60 parts by weight and 40 parts by weight (the physical properties of the mixture are shown in Table 1), respectively, and the surface temperature of the embossing roll was 119° C.

For the core-sheath-type conjugate fibers forming the nonwoven fabric obtained as described above, its fineness was 3.0 deniers and the component ratio by weight of polyethylene-based resin mixture to polypropylene was 30/70. Evaluation results for this nonwoven fabric are shown in Table 1.

Example 3

A conjugate fiber nonwoven fabric was obtained in the same manner as in the example 1, except that the blend proportions of polyethylene having a melting point of 130° C. [resin 1] and LLDPE having a melting point of 115° C. [resin 2] to the polyethylene-based resin mixture, which consisted of the above two types resins, were 50 parts by weight and 50 parts by weight (the physical properties of the mixture are shown in Table 1), respectively, and the surface temperature of the embossing roll was 117° C.

For the core-sheath-type conjugate fibers forming the nonwoven fabric obtained as described above, its fineness was 3.0 deniers and the component ratio by weight of polyethylene-based resin mixture to polypropylene was 30/70. Evaluation results for this nonwoven fabric are shown in Table 1.

Comparative Example 1

Ethylene-1-butene copolymer having a density of 0.950 g/cm$^3$, a melting point of 125° C., MFR (measured at 190° C. and at a load of 2.16 kg in accordance with ASTM D1238) of 60 g/10 min and Mw/Mn of 2.9, and polypropylene having an ethylene content of 0.4 mol % and a melting point of 165° C. were independently subjected to melt kneading in extruder. Then each molten was extruded through a spinneret with bi-component fiber spinning nozzles constructed in such a manner as to extrude the molten to form a core-sheath structure, so that the molten was subjected to conjugate spinning to form a concentric core-sheath-type conjugate fibers composed of a core portion comprised of the polypropylene and a sheath portion comprised of the above ethylene-1-butene copolymer. The web formed by depositing the core-sheath-type conjugate fibers obtained in the above manner on a collecting surface was subjected to entangling treatment by the hot embossing using an embossing machine consisting of a pair of steel embossing roll (roll diameter: 400 mm, stamped area ratio: 25%) having surface temperature of 121° C. and steel mirror roll (roll diameter: 400 mm), so as to obtain a conjugate fiber nonwoven fabric.

For the core-sheath-type conjugate fibers forming the nonwoven fabric obtained as described above, its fineness was 3.0 deniers and the component ratio by weight of ethylene-1-butene copolymer to polypropylene was 30/70. Evaluation results for this nonwoven fabric are shown in Table 1.

Comparative Example 2

A conjugate fiber nonwoven fabric was obtained in the same manner as in the comparative example 1, except that ethylene-1-butene copolymer having a density of 0.945 g/cm$^3$, a melting point of 123° C., MFR (measured at 190° C. and at a load of 2.16 kg in accordance with ASTM D1238) of 60 g/10 min and Mw/Mn of 2.7 was used and the component ratio by weight of the ethylene-1-butene copolymer to polypropylene was 60/40 and the surface temperature of the embossing roll was 119° C.

For the core-sheath-type conjugate fibers forming the nonwoven fabric obtained as described above, its fineness was 3.0 deniers. Evaluation results for this nonwoven fabric are shown in Table 1.

Comparative Example 3

A conjugate fiber nonwoven fabric was obtained in the same manner as in the example 1, except that LLDPE polymer having a density of 0.917 g/cm$^3$ and a melting point of 115° C. was used instead of LLDPE in the example 1 and the Mw/Mn and density of polyethylene-based resin mixture was 4.3 and 0.950 g/cm$^3$, respectively.

For the core-sheath-type conjugate fibers forming the nonwoven fabric obtained as described above, its fineness was 3.0 deniers. Evaluation results for this nonwoven fabric are shown in Table 1.

Example 4

A laminated nonwoven fabric having a basis weight construction of 7/3/7 (g/m$^2$)was formed by laminating by in-line system the nonwoven fabric obtained under the same conditions as in the example 1 on both sides of a melt-blown nonwoven fabric (fiber diameter of 3 $\mu$m) obtained by the melt-blowing process using HDPE which is used in the example 1. This nonwoven fabric laminate was subjected to entangling treatment in the same manner as in the example 1.

Evaluation results for this laminated nonwoven fabric are shown in Table 1.

In Table 1, PE denotes polyethylene, and PP denotes polypropylene.

POSSIBILITY OF INDUSTRIAL USE

The conjugate fiber nonwoven fabric of the present invention has an excellent softness and a high strength, in addition, it does not cause breaking troubles during the process. Because of the softness, it can be suitably used as a nonwoven fabric for sanitary materials.

TABLE 1

| | | | Example 1 | Example 2 | Example 3 | Comparative Example 1 | Comparative Example 2 | Comparative Example 3 | Example 4 |
|---|---|---|---|---|---|---|---|---|---|
| PE-based Resins (A) | Resin 1 | Melting point [° C.] | 130 | 130 | 130 | 125 | 123 | 130 | 130 |
| | | Density [g/cm$^3$] | 0.965 | 0.965 | 0.965 | 0.950 | 0.945 | 0.965 | 0.965 |
| | | Blend proportion (weight ratio) | 70 | 60 | 50 | 100 | 100 | 70 | 70 |
| | Resin 2 | Melting point [° C.] | 115 | 115 | 115 | — | — | 115 | 115 |
| | | Density [g/cm$^3$] | 0.915 | 0.915 | 0.915 | — | — | 0.917 | 0.915 |
| | | Blend proportion (weight ratio) | 30 | 40 | 50 | — | — | 30 | 30 |
| | PE-based Resin Mixture | MFR [g/10 min] | 60 | 60 | 60 | 60 | 60 | 60 | 60 |
| | | Mw/Mn | 2.7 | 2.7 | 2.7 | 2.9 | 2.7 | 4.3 | 2.7 |
| | | Density [g/cm$^3$] | 0.949 | 0.944 | 0.939 | 0.950 | 0.945 | 0.950 | 0.949 |
| Polypropylene (High-melting Point Resin (B)) | | MFR [g/10 min] | 60 | 60 | 60 | 60 | 60 | 60 | 60 |
| | | Mw/Mn | 2.4 | 2.4 | 2.4 | 2.4 | 2.4 | 2.4 | 2.4 |
| | | Melting point [° C.] | 165 | 165 | 165 | 165 | 165 | 165 | 165 |
| Component ratio | | Sheath/Core (PE/PP) | 30/70 | 30/70 | 30/70 | 30/70 | 60/40 | 30/70 | 30/70 |
| Evaluation Results | | Spinnability | ○ | ○ | ○ | ○ | ○ | x | ○ |
| | | Basis weight [g/m$^2$] | 23 | 23 | 23 | 23 | 23 | 23 | 7/3/7 |
| | | Stiffness (MD + CD) [mm] | 77 | 74 | 75 | 81 | 75 | 77 | 76 |
| | | Tensile strength [g/25 mm] MD | 1850 | 1980 | 2120 | 1530 | 1220 | 1790 | 1680 |
| | | Tensile strength [g/25 mm] CD | 250 | 260 | 280 | 210 | 140 | 240 | 260 |
| | | Water impermeability [mmAq] | 75 | 74 | 75 | 73 | 74 | 73 | 100 |

What we claim is:

1. A conjugate fiber nonwoven fabric which comprises conjugate fibers comprising a polyethylene-based resin (A) and a high-melting point resin (B), wherein a melting point of high-melting point resin (B) is higher than the highest melting point of the polyethylene-based resin (A) by 10° C. or more, the component ratio by weight of the polyethylene-based resin (A) to the high-melting point resin (B) being in the range of 50/50 to 10/90, wherein said polyethylene-based resin (A) is a mixture of an ethylene-based polymer (A-1) having a density in the range of 0.930 to 0.970 g/cm$^3$ and a higher melting point in a range of 120 to 135° C., and an ethylene-based polymer (A-2) having a density in the range of 0.860 to 0.930 g/cm$^3$ and a lower melting point in a range of 90 to 125° C. which is lower than the higher melting point of (A-1) by at least 5° C., the weight ratio of the ethylene-based polymer (A-1) to the ethylene-based polymer (A-2) being in the range of 75/25 to 30/70, and said polyethylene-based resin (A) forming at least part of the surface of the fiber continuously longitudinal.

2. The conjugate fiber nonwoven fabric according to claim 1, wherein the conjugate fibers are core-sheath or side-by-side conjugate fibers.

3. The conjugate fiber nonwoven fabric according to claims 1 or 2, wherein the molecular weight distribution (Mw/Mn) of said polyethylene-based resin (A), when measuring by gel permeation chromatography (GPC), is in a range of 1.5 to 4.0.

4. The conjugate fiber nonwoven fabric according to claims 1 or 2, wherein said high-melting point resin (B) is a propylene-based polymer having a molecular weight distribution (Mw/Mn), when measuring by gel permeation chromatography (GPC), in a range of 2.0 to 4.0.

5. The conjugate fiber nonwoven fabric according to claim 3, wherein said high-melting point resin (B) is a propylene-based polymer having a molecular weight distribution (Mw/Mn), when measuring by gel permeation chromatography (GPC), in a range of 2.0 to 4.0.

6. The conjugate fiber nonwoven fabric according to claim 4, wherein said propylene-based polymer is a propylene-ethylene copolymer having a melt flow rate (measured at a load of 2.16 kg and at 230° C. in accordance with ASTM D1238-95) in the range of 20 to 100 g/10 min and an ethylene-derived structural unit content in the range of 0.1 to 5.0 mol %.

7. The conjugate fiber nonwoven fabric according to claim 5, wherein said propylene-based polymer is a propylene-ethylene copolymer having a melt flow rate (measured at a load of 2.16 kg and at 230° C. in accordance with ASTM D1238-95) in the range of 20 to 100 g/10 min and an ethylene-derived structural unit content in the range of 0.1 to 5.0 mol %.

8. A nonwoven fabric for use in sanitary materials formed by laminating a melt-blown nonwoven fabric on the conjugate fiber nonwoven fabric according to claims 1 or 2.

9. A nonwoven fabric for use in sanitary materials formed by laminating a melt-blown nonwoven fabric on the conjugate fiber nonwoven fabric according to claim 3.

10. A nonwoven fabric for use in sanitary materials formed by laminating a melt-blown nonwoven fabric on the conjugate fiber nonwoven fabric according to claim 4.

11. A nonwoven fabric for use in sanitary materials formed by laminating a melt-blown nonwoven fabric on the conjugate fiber nonwoven fabric according to claim 5.

12. A nonwoven fabric for use in sanitary materials formed by laminating a melt-blown nonwoven fabric on the conjugate fiber nonwoven fabric according to claim 6.

13. A nonwoven fabric for use in sanitary materials formed by laminating a melt-blown nonwoven fabric on the conjugate fiber nonwoven fabric according to claim 7.

14. A sanitary material comprising the nonwoven fabric of claim 8.

* * * * *